US010168024B2

(12) United States Patent
Booij et al.

(10) Patent No.: US 10,168,024 B2
(45) Date of Patent: Jan. 1, 2019

(54) LIGHTING PANEL ADAPTED FOR IMPROVED UNIFORMITY OF LIGHT OUTPUT

(71) Applicant: PHILIPS LIGHTING HOLDING B.V., Eindhoven (NL)

(72) Inventors: Silvia Maria Booij, Eindhoven (NL); Hendrik Jan Kettelarij, Eindhoven (NL); Ronald Cornelis De Gier, Eindhoven (NL); Michiel De Jong, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/540,498

(22) PCT Filed: Dec. 15, 2015

(86) PCT No.: PCT/EP2015/079789

§ 371 (c)(1),
(2) Date: Jun. 28, 2017

(87) PCT Pub. No.: WO2016/110380

PCT Pub. Date: Jul. 14, 2016

(65) Prior Publication Data

US 2017/0356626 A1 Dec. 14, 2017

(30) Foreign Application Priority Data

Jan. 5, 2015 (EP) ..... 15150072

(51) Int. Cl.
*F21V 13/14* (2006.01)
*F21V 13/04* (2006.01)
(Continued)

(52) U.S. Cl.
CPC ..... *F21V 13/04* (2013.01); *F21S 8/028* (2013.01); *F21S 8/032* (2013.01); *F21S 8/033* (2013.01);
(Continued)

(58) Field of Classification Search
CPC ..... F21V 13/04; F21V 7/005; F21V 7/0008; F21S 8/033; F21S 8/032; F21S 8/028; F21Y 2103/10; F21Y 2115/10
(Continued)

(56) References Cited

U.S. PATENT DOCUMENTS 6,499,217 B1 * 12/2002 Yamada ..... H05K 1/0313 29/846
9,335,041 B2 * 5/2016 Marquardt ..... F21V 33/006
(Continued)

FOREIGN PATENT DOCUMENTS

CN 201877088 U 7/2010
CN 202521344 U 11/2012
(Continued)

*Primary Examiner* — Claude J Brown

(57) ABSTRACT

The invention provides a lighting panel, for use for example within a modular surface system, comprising one or more strips of solid state lighting elements associated with a reflector structure. The lighting panel is adapted for improved uniformity of light intensity across the width of its output area. Lighting elements comprise two or more subsets, each subset adapted to collectively generate a different light intensity profile across the width of the panel output window. The subsets are selectively adapted to generate profiles which, when blended, mutually offset one another's deviations from some common mean intensity across the width of the output window, thereby generating a combined intensity profile of improved uniformity. Embodiments include arrangements in which subsets of lighting elements are adapted to have differing actual or virtual optical path lengths to the reflector surface. Also provided are embodi-
(Continued)

ments further comprising an acoustically absorbing back surface, for providing an acoustic dampening function.

12 Claims, 6 Drawing Sheets

(51) Int. Cl.
*F21S 8/02* (2006.01)
*F21S 8/00* (2006.01)
*F21V 7/00* (2006.01)
*F21Y 103/10* (2016.01)
*F21Y 115/10* (2016.01)

(52) U.S. Cl.
CPC ..... *F21V 7/005* (2013.01); *F21V 7/0008* (2013.01); *F21Y 2103/10* (2016.08); *F21Y 2115/10* (2016.08)

(58) Field of Classification Search
USPC ..... 362/308
See application file for complete search history.

(56) References Cited

U.S. PATENT DOCUMENTS 9,945,533 B1* 4/2018 Orbe ..... F21V 3/00
9,995,866 B2* 6/2018 Chen ..... G02B 17/00
2003/0053310 A1 3/2003 Sommers
2004/0070967 A1* 4/2004 Kennedy ..... E04B 9/0435 362/147
2005/0157490 A1* 7/2005 Klose ..... F21S 8/024 362/146
2006/0139932 A1* 6/2006 Park ..... F21K 9/00 362/294
2006/0245188 A1 11/2006 Takenaka
2007/0138978 A1* 6/2007 Rains, Jr. ..... F21S 2/00 315/291
2007/0263379 A1* 11/2007 Dowling ..... F21S 8/024 362/151
2009/0023239 A1* 1/2009 Erchak ..... G03B 21/204 438/34
2010/0073783 A1 3/2010 Sun
2010/0157607 A1* 6/2010 Venhaus ..... F21V 7/0008 362/294
2010/0172152 A1* 7/2010 Boonekamp ..... F21V 7/0008 362/609
2010/0265705 A1* 10/2010 Fang ..... F21S 8/00 362/235
2011/0203147 A1* 8/2011 Van Herpen ..... H05B 37/0227 40/541
2011/0233568 A1 9/2011 An et al.
2012/0182733 A1* 7/2012 Cho ..... F21V 5/004 362/235
2013/0335962 A1* 12/2013 Wu ..... F21V 5/004 362/235
2014/0029254 A1 1/2014 O'Brien
2014/0211465 A1 7/2014 Kim et al.
2014/0233231 A1* 8/2014 Howe ..... F21V 3/0625 362/235
2015/0016108 A1* 1/2015 Howe ..... F21V 29/505 362/235
2015/0167904 A1* 6/2015 Whitehead ..... G02F 1/133603 349/69
2016/0061413 A1* 3/2016 Hedberg, Jr. ..... F21S 8/026 362/147
2016/0123005 A1* 5/2016 Booij ..... F21V 33/0088 362/235

FOREIGN PATENT DOCUMENTS

EP 2560155 A2 2/2013
JP 2013157258 A 8/2013
KR 20130068389 A 6/2013
WO 2010024507 A1 3/2010
WO 2013190447 A2 12/2013
WO 2014067949 A1 5/2014
WO 2014187788 A1 11/2014

* cited by examiner

LIGHTING PANEL ADAPTED FOR IMPROVED UNIFORMITY OF LIGHT OUTPUT

CROSS-REFERENCE TO PRIOR APPLICATIONS

This application is the U.S. National Phase application under 35 U.S.C. § 371 of International Application No. PCT/EP2015/079789, filed on Dec. 15, 2015 which claims the benefit of European Patent Application No. 15150072.5, filed on Jan. 5, 2015. These applications are hereby incorporated by reference herein.

FIELD OF THE INVENTION

The invention relates to a solid state lighting panel having improved spatial uniformity of light output.

BACKGROUND OF THE INVENTION

In construction, modular surface systems are commonly employed in order to reduce costs and construction time associated with building floors, walls and ceilings. A typical example of such a modular system is a suspended ceiling, incorporated within many professional and office environments, standardly comprised of a plastic or metal grid defining square/rectangular recesses, these filled with tessellating panels or tiles spanning the ceiling, and often interspaced at regular points with dedicated luminaire lighting panels.

Traditionally such lighting panels utilise one or more fluorescent tubes in combination with light redirecting reflectors. However, increasingly, solid state lighting elements, such as LEDs, are being used in lighting panel applications as an alternative to fluorescent tubes. LEDs carry numerous general advantages compared with traditional (fluorescent or incandescent) light sources including long lifetime, high lumen efficiency, low operating voltage and fast modulation of lumen output. Additionally, in office environments it is generally desired that modular systems incorporate acoustic dampening elements in order to mitigate the transmission of sound across large open spaces. In particular, it is often desirable that lighting panels themselves incorporate acoustically absorbing tiles or layers, such that comparatively large portions of the total ceiling surface area may be provided with lighting, without compromising on acoustic dampening.

Hence LED modular lighting panels carry numerous advantages compared with fluorescent panels. However, in contrast to a tubular lighting element, an individual LED package is able to generate light emission across only a very narrow output area. Hence a plurality of LEDs are typically utilised within such devices, for example arranged in arrays beneath a reflector, the reflector adapted to redirect emitted light across an output window located at the base of the panel.

WO 2013/190447 for example discloses a modular lighting device comprising an acoustically absorbing tile, several rows of LED elements and a reflector arrangement.

WO 2014/187788 discloses a light-emitting acoustic panel that may be mounted in a ceiling. The light-emitting acoustic panel comprises a sound-absorbing layer and a light-transmissive layer arranged in parallel such that a space is formed in-between. In the space a light source and a reflector are arranged such that light emitted by the light source is redirected by the reflector and emitted towards a reflective side of the sound-absorbing layer. The light source is an elongated light source that is arranged along a line that is parallel to an edge of the light-emitting acoustic panel, wherein the elongated light source comprises a plurality of LED elements.

Known LED lighting panels have the disadvantage that it is difficult to achieve large lateral sizes, for example greater than approximately 60×60 cm, while maintaining an homogeneous light distribution, in order to avoid brighter and darker spots occurring at various points across the width of the window. Such non-uniformity of light intensity is aesthetically unsatisfying as well as functionally inefficient.

It is particularly difficult to avoid this non-uniformity with panels that also incorporate acoustic functionality.

Desired therefore is a lighting panel utilising strips of solid state lighting elements, and able to incorporate an acoustically absorptive tile layer but wherein the intensity distribution of light generated across the width of the panel area exhibits improved uniformity, even for panels of large lateral size.

SUMMARY OF THE INVENTION

The invention is defined by the claims.

According to an aspect of the invention, there is provided a lighting panel, comprising:

a light output area, having a width across which a light output is to be generated;

a reflector structure, having a reflective surface facing at least in part in the direction of the light output area; and one or more rows of solid state lighting elements, having a light-emitting top surface, arranged beneath the reflector structure, the row or rows extending perpendicularly to the width of the light output area; wherein:

the solid state lighting elements together comprise at least two subsets of lighting elements, the subsets including:

a first subset creating a first light intensity profile across the width of the light output area, and a second subset creating a second light intensity profile across the width of the light output area, wherein the combined intensity profiles create a third light intensity profile across the width of the light output area of greater uniformity than either the first or second intensity profiles, and wherein the first subset of solid state lighting elements are adapted to generate beam profiles against the surface of the reflector corresponding to virtual light source positions of a first perpendicular displacement relative to the light output area, and the second subset of solid state lighting elements are adapted to generate beam profiles against the surface of the reflector corresponding to virtual light source positions of a second perpendicular displacement relative to the light output area.

The lighting panel is comprised of one or more strips of solid-state lighting elements, facing (in one arrangement) 'upward', toward the surface of a reflector arranged above. The reflector may face at least partially in the direction of a light-transmitting output area (e.g. a light output window), located at the base of the panel, beneath the strips of lighting elements. By 'faces at least partially' is meant that it has a surface normal with at least some vector component in the direction of the output area.

The lighting elements might, for example, comprise one or more LEDs, either as bare components, or in combination, for instance, with beam-shaping optics.

The lines of lighting elements may be arranged in substantially the same direction: running perpendicular to the width-wise extension of the output window below. Light emitted by the lighting elements falls on the reflector structure above, and is reflected or bounced (possibly several times) from and/or between one or more points on the reflector surface. After some lesser or greater amount of bouncing, light is directed toward the output area at the base of the panel, where it may be either directly propagated out from the panel, or, alternatively, diffused or scattered on passage through a provided output window.

Among the lighting elements are arranged two subsets, each adapted to collectively generate a different light intensity profile across the width-wise extension of the output window. The two subsets are selectively adapted so as to generate intensity profiles which mutually offset one another's deviations from some (possibly) common mean intensity across the length of the output area. In this way, an intensity profile may be established across the output window of far greater uniformity than is generated by either of the subsets on its own, since peaks and troughs, which naturally occur due to the nature of the reflecting process, may be 'ironed out' by superposing a specially adapted conjugate intensity profile generated by a second subset.

By 'intensity profile' is meant broadly the distribution of light across the width of the output area, which might in practice be represented or understood in terms of the distribution or spread of any number of specific physical quantities. For example, an intensity profile in the present context might be represented by a plot of luminance across the panel's width, or simply luminous intensity, or of luminosity or any other measure having direct physical relation with a measure of intensity or brightness. Profiles might also be distinguished in their colour distribution, for example.

The lighting elements of the first subset of lighting elements may be interleaved with the lighting elements of the second subset of lighting elements.

According to this embodiment, the two subsets are substantially spatially entwined or co-mingled, such that the profile generated by the one superposes as neatly as possible onto the profile generated by the other. In this way, the two profiles are 'blended' to the greatest extent possible: ideally the entire extent of the first profile overlaps with the entire extent of the second. Since it is from the blending of the two conjugate profiles that uniformity is realised, maximal spatial overlapping ensures maximal capacity for uniformity.

In one particular example, the reflector structure may have a constant cross-sectional shape along the row direction.

In some examples, the reflector may have a curved or otherwise non-planar form, extending in a height-wise direction. In one embodiment of the invention, the rows of lighting elements are arranged beneath an associated reflector such that they run parallel with a length of the reflector along which the reflector has a constant shape. Thus, the height-wise displacement from the base of the rows of lighting elements to the surface of the reflector remains constant along the entire length of the row. This constant reflector shape is the reflector cross section, cut perpendicularly at points along an axis running parallel with the rows.

Such an arrangement allows that the intensity profile generated by each strip, across the width-wise extension of the output area, is at every point along the length (perpendicular to the width) of the window the same (ignoring the edge effects at the ends of the rows). This ensures not only that there is uniformity of intensity across the width of the window, but also across the length, since the uniform width distribution generated by the superposing profiles is faithfully reproduced at every point along the length.

The reflector structure may comprise a first portion at one side of the panel, and a second portion at the other side of the panel, each portion having a respective set of one or more rows of lighting elements arranged beneath.

The reflector may in this way be split into two portions, each positioned along an opposite side of the panel. For example, the two portions might be arranged at opposite ends of the width of the panel, and furthermore, may, in some embodiments, each comprise a reflective surface with a surface normal having at least some vector component in the direction of the output window, and at least some vector component in the direction of the other reflector. According to this example, at least some of the light incident upon either portion of the reflector, originating from a lighting element directly beneath, is initially reflected in the direction of the opposite portion. At the opposite portion, the light might, in turn, be reflected back toward the first portion, or, dependent on the shape of the portions, downward toward the output window, or toward the respective lighting elements positioned beneath.

The advantage of dual, separated portions is that light may be spread more evenly over the entire width of the output area. With a single reflector, there may naturally occur a pattern of diminishing (mean) intensity in directions away from the reflector, undermining the uniformity of the distribution. By utilising a second reflector portion, located at a different position, regions of low mean intensity for the first reflector may be blended with regions of high mean intensity for the second reflector, and hence greater uniformity achieved.

For each row of lighting elements, adjacent elements in the row may belong to different subsets.

Such an arrangement ensures a closest degree of 'blending'. For an embodiment comprising just two subsets, for example, consecutive lighting elements in each row alternate between the first subset and the second subset, such that for the row as a whole, the two subsets are completely evenly interspersed. As a result, the two corresponding intensity profiles are effectively precisely 'overlaid' on one another, allowing for maximal possible uniformity across the output window.

The first subset of solid state lighting elements may be adapted to generate beam profiles against the surface of the reflector of a first incident intensity, and the second subset of solid state lighting elements may be adapted to generate beam profiles against the surface of the reflector of a second incident intensity.

The differing 'intensity profiles' created by each subset collectively may hence emerge from an arrangement in which the individual elements of the two subsets are adapted to generate individual beams of differing, subset-specific, incident intensities at the surface of the reflector. By selectively tuning the two characteristic intensities, the emergent profiles may be adjusted so as to together generate a uniform intensity distribution across the output area.

A number of possibilities exist for adapting the different subsets of lighting elements to generate different intensity profiles across the width of the output area. In one possibility for example, the first subset of solid state lighting elements may have light source positions corresponding to a first displacement relative to the reflector surface, in a direction normal to the light output area; and the second subset of solid state lighting elements may have light source positions corresponding to a second displacement relative to the reflector surface, in a direction normal to the light output area.

According to this arrangement, the first and second subsets of lighting elements are arranged so as to have beam source positions located at different relative distances from the surface of the reflector. Where lighting elements of the two subsets are arranged so as to propagate light in substantially the same angular direction, and in beams of substantially the same width and collimation, the result is that light rays originating from elements belonging to different subsets fall incident on the reflector at a different range of incidence angles. Light beams generated by elements having closer light source positions, for example, will fall on the reflector surface at a narrower range of angles than those generated by elements having more distant light source positions. Consequently, light rays generated by the different subsets of lighting elements reflect from the reflector surface with a different distribution of angles, consequently creating differing reflection intensity profiles across the width of the output area below.

In the particular example above, light source positions are varied through arranging the lighting elements of the two subsets such that their light emitting surfaces or apertures are located at differing 'vertical' distances from the surface of the reflector.

In the lighting panel of the present invention however, the first subset of solid state lighting elements is adapted to generate beam profiles against the surface of the reflector corresponding to virtual light source positions of a first perpendicular displacement relative to the light output area, and the second subset of solid state lighting elements is adapted to generate beam profiles against the surface of the reflector corresponding to virtual light source positions of a second perpendicular displacement relative to the light output area.

In this way, intensity distributions of the two sets of beams are varied, not through arranging the lighting element apertures to occupy different vertical displacements from the reflector, but rather through optically manipulating the output beams so as to generate a shifted 'virtual' light source of the beam.

For example, one or more of the solid state lighting elements might comprise a refracting layer positioned optically downstream from the light-emitting top surface. Here, light emitted by the corresponding lighting elements is refracted as it passes through the refracting layer, thereby perpendicularly shifting the virtual light source position of the generated beam profile relative to the surface of the reflector structure. One subset of lighting elements, for example, might comprise refracting layers, while the other subset does not, thereby inducing differing ranges of incidence angles for the beams of the two subsets. Alternatively, both subsets might incorporate refracting layers, but comprised of materials of differing refractive indices or of different thicknesses.

In one example, the refracting layer might comprise a refracting plate.

The refracting plate might for example comprise a glass or plastic sheet of refractive index greater than the surrounding atmosphere of the lighting panel.

In any embodiment, each of the one or more rows of lighting elements may be coupled to the surface of a respective PCB, and the surface of each PCB may have a plurality of perpendicular displacements from the output area at different points along the length of the row.

For example, a PCB having alternating higher and lower displacements for consecutive lighting elements in a particular row might be utilised in order to realise the above embodiment comprising lighting elements having light source positions at differing vertical displacements from the reflector structure. Said PCB might simply comprise alternating thicker and thinner sections, or might be bent or deformed into an undulating shape, having higher and lower adjacent portions.

The reflector structure may comprise one or more parabolic reflector elements.

The lighting panel may further comprise an acoustically absorbing back surface, with the reflector structure sandwiched between the light output area and the back surface.

Such an embodiment carries the advantage of providing acoustic insulation across its back surface. For example, where a number of the lighting panels are installed as part of ceiling lighting in a room, the acoustic tile helps prevent sound being carried across different locations in the room. By incorporating such sound absorbing elements within the lighting panels, effective acoustic dampening may be achieved by a modular surface system in which lighting panels occupy a large proportion of the total area of the surface.

The light output area of the lighting panel may comprise a partially transparent layer, such as a partially transparent surface sheet.

In this embodiment, light incident at the output area falls upon the semi-transparent or translucent surface sheet, and is—to some extent—dissipated or scattered at it passes through said sheet. The invention ensures that light falls upon the output area with a uniform intensity distribution, and hence to an observer of the panel, looking from beneath the output window, the appearance is of a light-emitting panel having uniform brightness across the expanse of its output area.

The solid state lighting elements might comprise one or more LEDs.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting panel, for use for example within a modular surface system, comprising one or more strips of solid state lighting elements associated with a reflector structure. The lighting panel is adapted for improved uniformity of light intensity across the width of its output area. Lighting elements comprise two or more subsets, each subset adapted to collectively generate a different light intensity profile across the width of the panel output window. The subsets are selectively adapted to generate profiles which, when blended, mutually offset one another's deviations from some common mean intensity across the width of the output window, thereby generating a combined intensity profile of improved uniformity. Examples include arrangements in which subsets of lighting elements are adapted to have differing actual or virtual optical path lengths to the reflector surface. The lighting panel may further comprise an acoustically absorbing back surface, for providing an acoustic dampening function. Methods of generating substantially uniform light output from a lighting panel are also provided.

The invention is based on the principle of superposing a plurality of individually non-uniform light distributions in order to generate an overall output profile which appears homogenous across the total expanse of any visible output area. This is achieved through adapting the common general approach of using lighting sources in combination with re-directing reflector structures, by manipulating the optical arrangement of the lighting elements so as to generate at least two subsets of light sources, each adapted to realise a different intensity profile across the expanse of the reflector.

Figure 1:
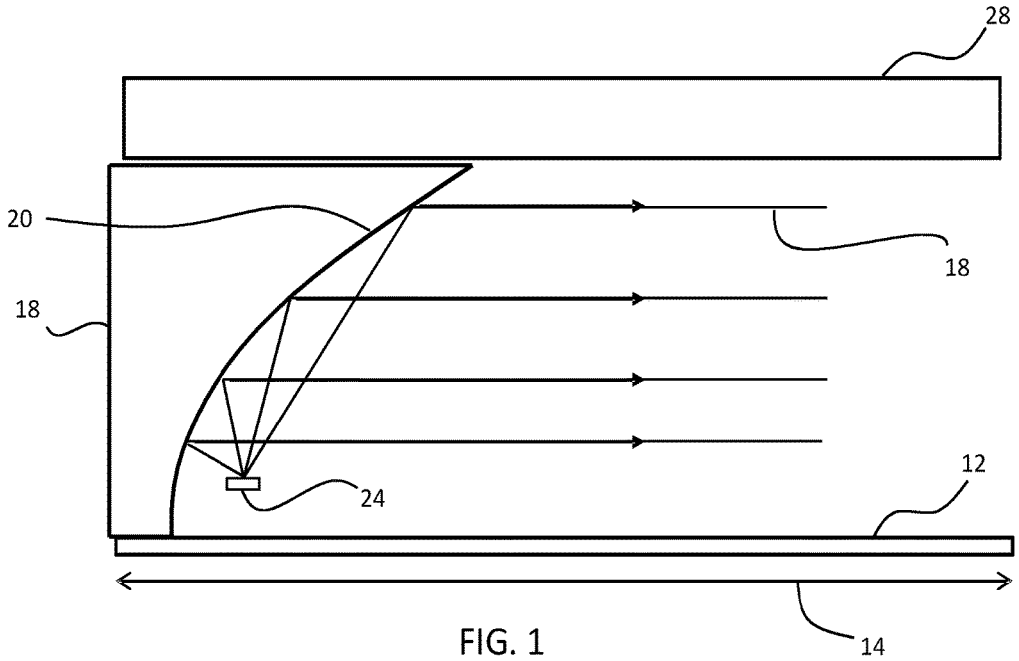
FIG. 1 shows a schematic diagram of the optical arrangement of a simple possible example of a lighting panel.

In FIG. 1 is shown the optical arrangement of a simple example of a first embodiment. A row of solid state lighting elements 24 is arranged beneath a reflector structure 18, each solid state lighting element having a light emitting top surface facing in the direction of the reflective surface 20 of the reflector structure. The row of lighting elements is arranged perpendicular to the width-wise extension 14 of the panel (i.e. facing into the page, as shown in FIG. 1), and the reflector structure extends similarly, in parallel with the row direction. Beneath the reflector and lighting elements is a light output area 12. In some examples, the light output area might comprise a partially transparent layer or tile, said layer acting to disperse or scatter light as it passes outward from the panel, thus generating a homogenous and glare-free light output, aesthetically satisfying to observers of the panel. In other (non-limiting) examples, however, the output area may comprise simply an open space, or may comprise a partial layer, or may comprise a fully transparent layer, depending on intended applications.

Note that in the descriptions which follow, the output area may alternatively be described as an output window, or simply a window. These terms are to be understood as interchangeable and non-limiting—in particular, window is not intended to entail use of any particular material or framing arrangement.

Additionally, in descriptions above and below specific directional terms may be referred to, such as 'vertical', 'upward', 'leftward', 'back', 'downward' etc. Where these are used, they are to be read purely as exemplary or illustrative, employed merely to assist in clarity and brevity of the description. In other embodiments, naturally alternate, equivalent specific directionalities might apply, although the relative displacements, positions or paths may nonetheless remain substantially the same.

There is depicted in FIG. 1 only a single row of lighting elements beneath the reflector. However, in various embodiments, pluralities of rows are provided, arranged in parallel with respect to one another, forming an array of lighting elements extending both width-wise and length-wise beneath the reflector.

In the example of FIG. 1, the device additionally comprises an acoustically absorptive back panel 28 which may comprise an acoustic tile for performing an acoustic dampening function. Such a feature may be particularly applicable, for example, in ceiling lighting applications in open plan offices. It may be desirable to limit the extent to which noise generated at one part of the office travels across to other parts of the office. Here, an acoustically absorptive back layer in lighting panels allows for efficient and effective noise dampening, even in arrangements in which lighting panels comprise a large proportion of total ceiling surface area. Where the lighting panels themselves do not comprise acoustic absorption functionality, dedicated acoustic ceiling tiles may be used in the spaces in between installed lighting panels, and where a particular dampening specification is required, this may limit the possible total surface area which can be covered by (non-absorbing) lighting panels. In contrast, lighting panels incorporating acoustic functionality allow for the entire ceiling surface of such an area to be covered with the panels, providing a seamless and 'decluttered' aesthetic to the space, with every ceiling panel having identical appearance.

Light emitted by the lighting elements 24 falls upon the reflector 20 and is redirected—at least partially—along the width-wise extension of the panel, thus allowing light, having initially highly localised emission source, to be redistributed across a wide area of the panel. In particular, in the example depicted by FIG. 1, the reflector has a parabolic or near-parabolic surface, meaning that light propagated from a point coincident with the focal point of the reflector will all be redirected along the width-wise axis of the panel, as indicated by reflected rays 18. In other embodiments, however, the reflector may comprise a differently shaped surface or be arranged differently with respect to the row(s) of lighting elements. The reflector may be adapted, for example, to reflect all or most incident light toward the direction of the output area, rather than in a width-wise direction, or may be adapted to reflect incoming rays at a range of angles across the surface of the output area.

In some embodiments, the reflector is adapted to redistribute some or all incident light across the back surface of the lighting panel. For example, in embodiments comprising an acoustic tile, as in the example of FIG. 1, the tile may comprise a semi-reflective surface adapted to reflect light incident from the reflector downwards toward the output area. In some examples, this semi-reflective surface might be partially dispersive, such that light is directed toward the output area having a spread of ray propagation angles. This ensures that there is no direct 'image' of the LED module projected in the direction of the observer, and/or no corresponding highly bright spots visible on an output window surface, Additionally, in some embodiments, the reflector may not be curved, but rather planar, or may comprise jointed planar sections disposed at differing angles (i.e. faceted rather than curved).

Figure 2:
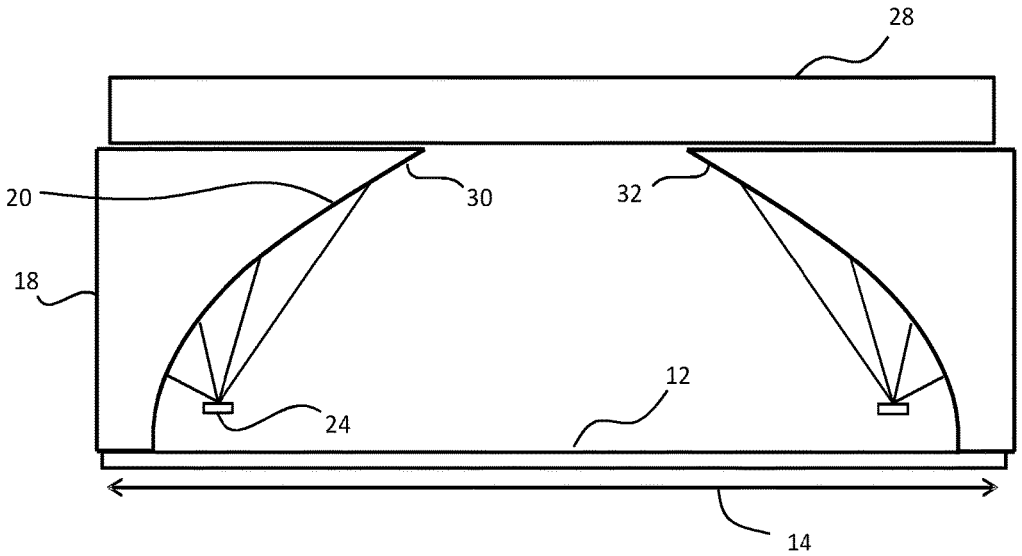
FIG. 2 shows a schematic diagram of another possible example of a lighting panel, having a reflector structure comprised of two separate portions.

In one particular embodiment, an example of which is shown in FIG. 2, the reflector structure comprises two distinct portions, the portions arranged facing one another at opposite sides of the lighting panel, and each portion having a respective row or rows of lighting elements disposed beneath it. In the particular example of FIG. 2, the reflector portions again have parabolic or near parabolic surfaces, meaning that light incident from lighting elements at or near the focal point of a first parabolic portion 30 (indicated by elements 24) is reflected along a direction parallel with the surface of the output window 14, toward the surface of the oppositely arranged portion 32. Once incident at the surface of the second portion, the light is either reflected directly toward the output window, or, in some embodiments, first directed downward toward the respective rows of lighting elements beneath, before being re-reflected back, via the second portion of the reflector, toward either the output window, or the acoustic tile (where one is provided). As discussed above, an acoustic tile may be adapted to reflect incident light toward the output area semi-dispersively, improving uniformity of intensity profiles across the output area.

Note the dimensions in the figures are not to scale. For example, the width of the panel is preferably much greater than the depth (i.e. the vertical height in the case of a ceiling panel). Thus, the reflectors will be much further apart relative to the height than appears from FIG. 2.

The advantage of dual, separated portions is that light may be spread more evenly over the entire width of the output area. With a single reflector, there may naturally occur a pattern of diminishing (mean) intensity in directions away from the reflector, undermining the uniformity of the distribution. By utilising a second reflector portion, located at a different position, regions of low mean intensity for the first reflector may be blended with regions of high mean intensity for the second reflector, and hence greater uniformity achieved.

In practical embodiments, the surfaces of the two portions may be adapted so as to deviate from the parabolic, perhaps adopting instead a different conic shape of greater or lesser eccentricity, or a different type of curve all together. By selectively adapting the shapes of one or both of the reflector portions, the distribution of reflection angles of incident light may be attuned, allowing for realisation of different reflection profiles across the surface.

Any chosen mirror arrangement however, suffers the problem that the reflected intensity distribution across the output window is not uniform across the entire expanse. One usually ends up with too much light at some locations, and not enough light at other locations. Such a result is a natural consequence of the difficult task of spreading out light—having localised source positions—across a (relative to the lighting elements) very large surface area, using mirrored structures. In particular, one normally sees twin maxima of intensity at panel edges declining toward a central minimum at the middle of the panel (or vice versa).

However, it has been observed that moving lighting elements in the z-direction (where the x and y directions are defined as spanning the horizontal plane, i.e. spanning the width and length respectively of the output window in the embodiments of FIGS. 1 and 2) changes the positions of the peaks and valleys in the light distributions. In FIGS. 1 and 2, the z-axis is in the up-down direction of the page.

Figure 3:
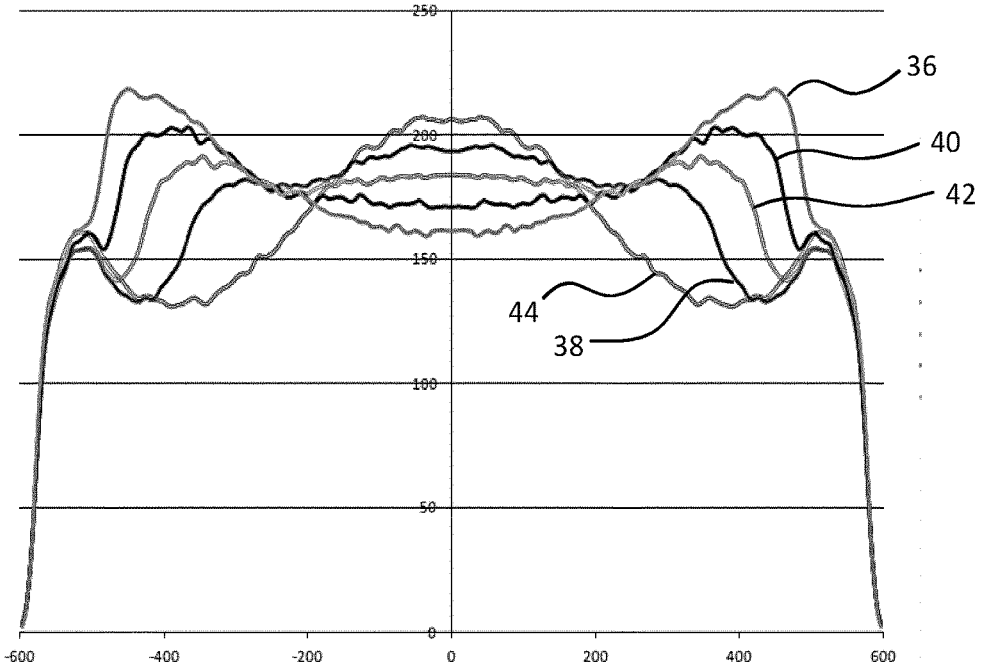
FIG. 3 shows a plot corresponding to simulated luminance distributions across the width of a lighting panel, for sets of lighting elements arranged at different relative heights.

In FIG. 3 are shown a number of plots 36, 38, 40, 42, 44 illustrating simulated light distributions for lighting elements disposed at differing z positions (for a parabolic reflector held at constant position, with its lowest-most point positioned at z=0). The y-axis of FIG. 3 corresponds to luminance in units of Candela/$m^2$, and the x-axis to displacement in the x-direction (corresponding to width direction 14) in units of mm.

Distribution 44 corresponds to the lighting elements at the lowest z-position, followed, in ascending order of z-location, by 38, 42, 40 and 36. Distribution 44 corresponds to lighting element positioned at z=0, 38 to lighting element at z=0.3 mm, 42 to z=0.5 mm, 40 to z=0.7 mm, and 36 to z=0.9 mm. All of the lighting elements are positioned at the same x-position, 8 mm from the left-most point of the reflector, said left-most point having displacement from the centre of the lighting panel of 590 mm.

Each of the generated distributions is individually non-uniform, displaying the above described characteristic edge effects and central maximum/minimum. However, it is noticeable that profiles 36 and 38 display distributions having peaks and troughs which approximately oppose one another at the same points. When these two distributions are superposed, or 'averaged' (as illustrated in FIG. 4), the resulting combined distribution 46 exhibits significantly improved uniformity across the x-direction.

It follows therefore that by generating both distributions 36, 38 within the lighting panel at the same time, at substantially the same y-location, such that the two become superposed, a resultant intensity distribution 46 is generated across the width of the output area having greatly improved homogeneity compared with either 36 or 38 on its own. Furthermore, the effect may naturally be extended back along the entire length of the panel, by establishing two subsets of lighting elements, with member elements disposed at regular points along the y-axis (i.e. at regular points along one or more rows of lighting elements, since rows extend perpendicularly to the width of the panel), each subset adapted to generate one of the two distributions at each y-location at which a member element is located. Each subset thereby effectively generates a two-dimensional intensity distribution across the surface of the output window wherein the superposition of the two distributions creates a combined profile across the whole expanse of the output area which exhibits substantial homogeneity in both x and y directions.

Note that the above described 'extension' of the width-wise intensity distribution along the length of the panel assumes that at all points along the length of each row, the relative position/arrangement of the lighting element at that point with respect to the reflector structure is identical; it is assumed that the optical arrangement is the same for any point along the row. In structural terms, this corresponds to the reflector cross-section, cut perpendicularly at points along an axis running parallel with the rows (i.e. the y-axis), having uniform shape at all points along said axis. Or, equivalently, such an arrangement corresponds to rows of lighting elements which are arranged so as to run parallel with a height contour of the reflector structure.

Figure 4:
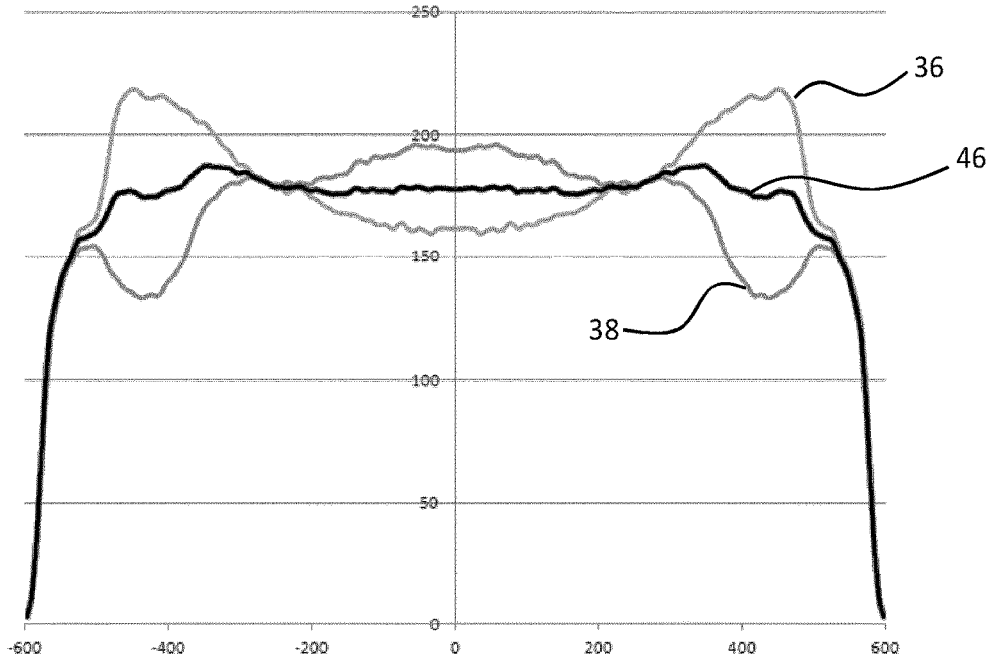
FIG. 4 shows a plot illustrating a simulated blending of two of the luminance distributions of FIG. 3 to generate a distribution of improved uniformity.

Although in the simulated luminance plots of FIGS. 3 and 4, the different distributions are generated by placing source lighting elements at differing z-positions, similar variations in the intensity profile may be brought about through different sorts of manipulation. Most generally, the intensity profile created by a given subset of lighting elements may be varied simply by varying the particular range or profile of incidence angles which beams generated by individual member elements create against the surface of the reflector. A subset of lighting elements which creates light incident at a different distribution of angles, generates a reflected light distribution across the output area which is correspondingly altered. Moving all members of a given subset closer the reflector (i.e. changing their z-position) is one means of achieving this effect, since beams incur less lateral dispersion during their shorter journey to the reflector surface. However, other equivalently efficacious means also exist, and will be described in more detail in some of the embodiments which follow.

The lighting elements of the two different subsets do not have to be positioned directly adjacent to one another. However, for maximal blending of the two profiles, and hence the best possible smoothing of the intensity distribution, it is preferable to spatially mix the two subsets as finely as possible. In one embodiment therefore, rows of lighting elements are arranged such that adjacent elements belong to different subsets. In an example in which the lighting elements comprise just two subsets, this corresponds to rows in which consecutive elements alternate between those belonging to the first subset, and those belonging to the second subset.

Figure 5:
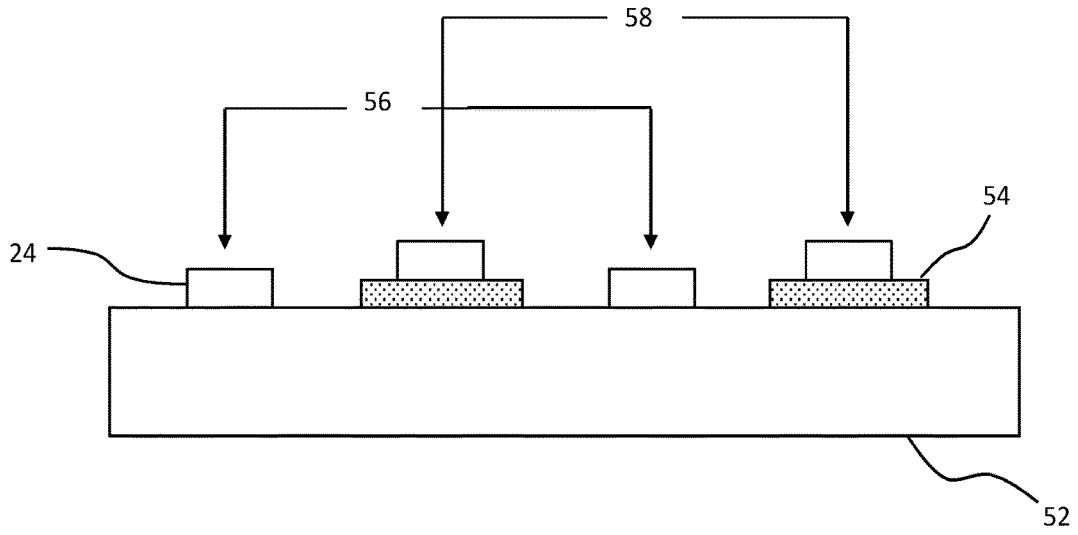
FIG. 5 shows a portion of a first example arrangement of lighting elements.

A small section of an example row in accordance with such an embodiment is depicted in FIG. 5. A first subset 56 of lighting elements 24 is mounted on a PCB 52, and interleaved with a second subset 58 of lighting elements mounted on the same PCB. In the resulting arrangement, all adjacent lighting elements in the row belong to differing subsets.

In the particular example of FIG. 5, the two subsets of lighting elements are optically characterised by their light emitting surfaces occupying different vertical displacements, hence embodying the z-location variation illustrated by the plots in FIGS. 3 and 4. In particular, the subsets are arranged having differing displacements from the surface of the reflector structure, in a direction normal to the surface of the output window.

In FIG. 5, the differing displacements are realised though submounts 54 positioned beneath the lighting elements of the second subset 58, hence raising their vertical position relative to the PCB 52 upon which the entire row is mounted. Where the PCB is aligned such that the row is parallel with a height contour of the reflector (as described above), then this arrangement results in two subsets of lighting elements, wherein the members of each subset all share the same vertical or 'heightwise' displacement from the surface of the reflector structure. Hence at all points along the lengthwise extension of the panel, substantially the same two intensity distributions are created and superposed across the width of the panel, generating the same blended distribution extending back from the front to the rear of the output area. The result is a distribution across the entire expanse of the panel which to an observer appears substantially uniform at all points.

Figure 6:
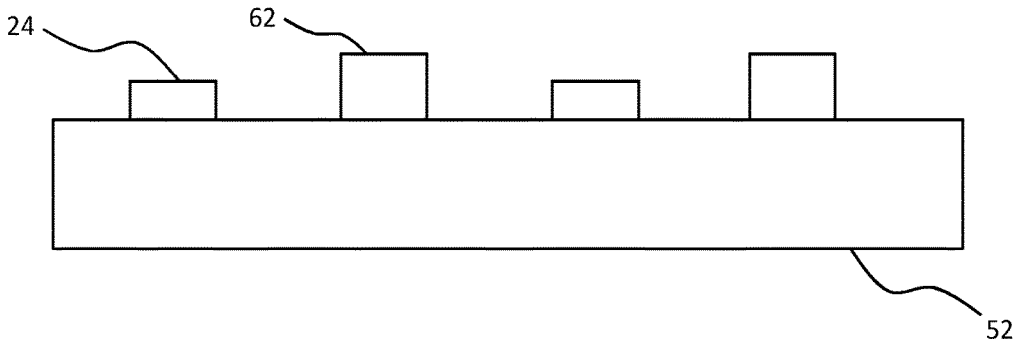
FIG. 6 shows a portion of second example arrangement of lighting elements.

In other examples, alternative arrangements may be employed in order to realise differing relative displacements of light emitting surfaces of one or more of the subsets of lighting elements. In FIG. 6 is shown an example of one such alternative arrangement. Here, rather than employing submounts to selectively the raise the level of particular lighting elements, instead a second subset of lighting elements 62 are pre-fabricated having differing vertical extension. These lighting elements, like those populating the first subset 24 have light emitting top surface, and hence, by simply extending the overall height of the component, the same displacing effect is achieved as in the example of FIG. 5.

As discussed above, in its most general form, the invention requires only that different subsets of lighting elements are adapted such that their populating lighting elements generate beam profiles against the surface of the reflector comprising rays having a different range or profile of incidence angles. Changing the physical locations of the lighting elements relative to the reflector surface achieves this, since a close light source will generate a narrower incident beam profile, and hence a narrower range of incidence angles. However, the same effect may equivalently be achieved simply by optically manipulating the output beams of the subset in question such that the virtual light source position is shifted in an equivalent manner. This may be done, for example, by refracting outgoing light, thereby effectively narrowing the lateral extent of the generated beam, and hence vertically shifting the virtual source position of the beam.

Figure 7:
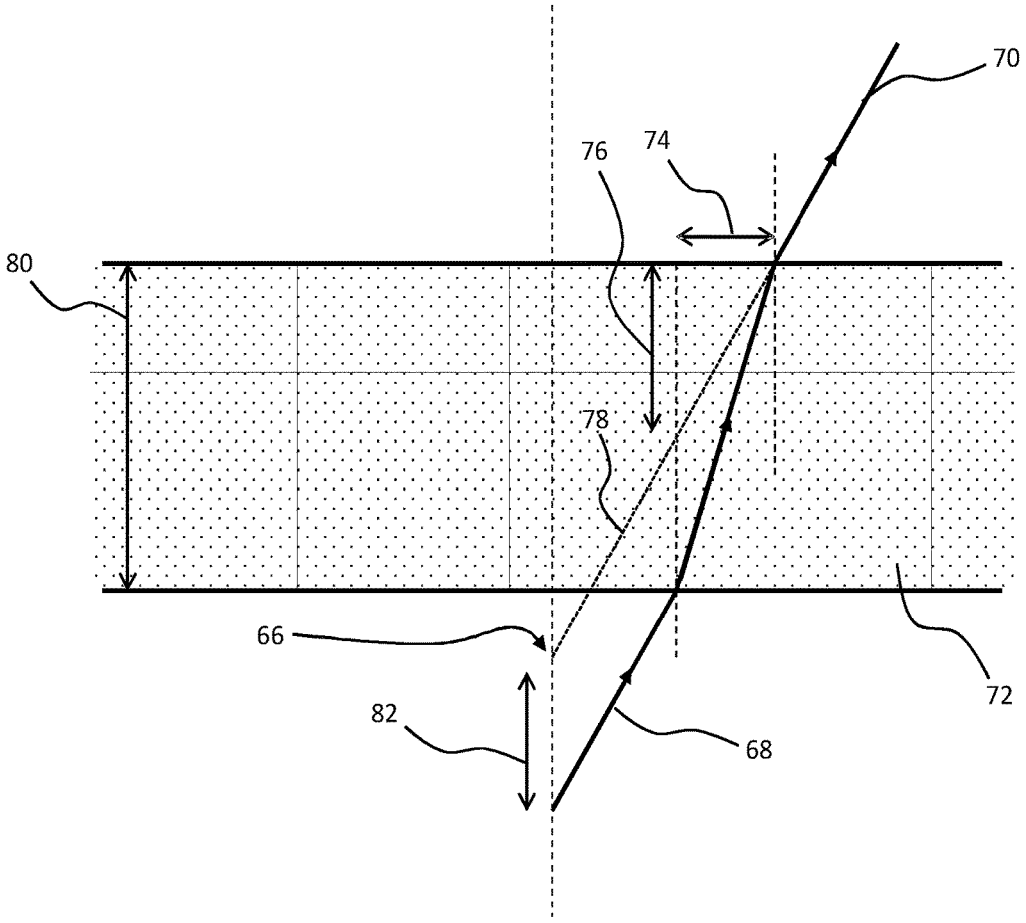
FIG. 7 shows an optical diagram illustrating an example of a virtual light source shift generated by a refracting layer.

In FIG. 7 is shown a ray diagram depicting the optical concept behind such an embodiment. A refractive layer 72 consisting of any medium having higher refractive index than that of air (or other surrounding medium) is positioned optically downstream from one or more lighting elements. Outgoing light rays 68 from the lighting element(s) (a single exemplary ray is shown for simplicity) are incident at the bottom boundary of the layer and bend toward the boundary normal as they pass through. On exiting the layer, the outgoing ray 70 bends back again, reassuming a path parallel with that of the incoming ray. However, the effect of the refraction is to effectively shift the outgoing path of the ray relative to the path it would otherwise have taken leftward (as shown on FIG. 7) by distance equal to that indicated by 74 in the diagram. Equivalently, by notionally extrapolating the outgoing ray 70 backward, to find a 'virtual' source ray 78, having a virtual light source 66, the effect of the refraction is shift the virtual light source position vertically upwards by a distance equal to that indicated by 82 in the diagram. Vertical shift distance 82 is equal to the total height of the refracting layer 80, less the distance indicated by label 76 in the diagram of FIG. 7, although the latter is in general dependent upon the refractive index of the material used for the refracting layer.

The refracting layer 72 naturally realises the same effect as that described above for all emission rays of the source lighting elements, with the overall result being to effectively narrow the outgoing beam (since all rays are shifted laterally toward the horizontal position of their source location), which corresponds equivalently to shifting the source position of the entire beam upwards by a proportional amount. Hence the refracting layer achieves the same optical effect as physically displacing lighting elements of a particular subset.

Figure 8:
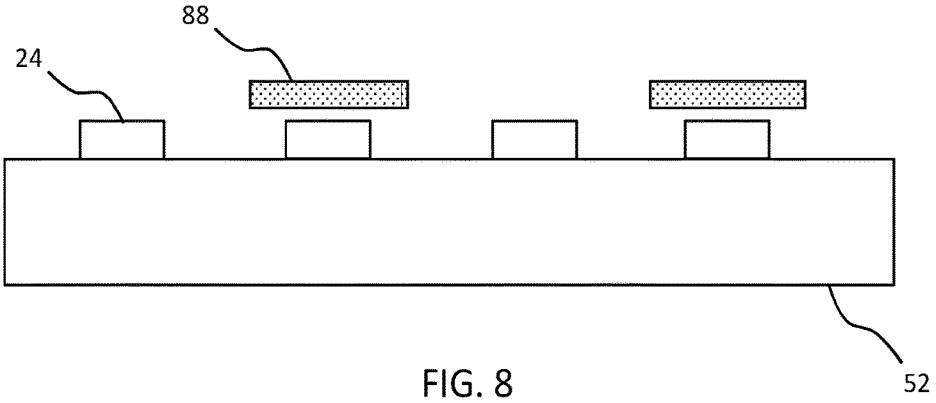
FIG. 8 shows a portion of a third example arrangement of lighting elements, comprising refracting plates for shifting virtual light source positions.

In FIG. 8 is shown a small section of an example of a row of lighting elements 24, employing the optical principle shown in FIG. 7. As in FIGS. 5 and 6, two subsets are depicted, with adjacent lighting elements belonging to different subsets, the lighting elements mounted atop a PCB 52. Above elements belonging to one of the two subsets are positioned refracting plates 88 which constitute the refracting layer 80 of FIG. 7. The refracting plates act, as described above, to shift the virtual light source positions of one but not the other subset of lighting elements, thereby inducing differing intensity profiles to be generated by the two.

The refracting plates might, for example, consist of a layer of glass or plastic. However, any material having a refractive index greater than the atmosphere or other environment immediately surrounding the elements 24 may equivalently be employed.

In the example depicted by FIG. 7, only one of the two subsets of lighting elements comprises refracting plates. However in other examples, both subsets might comprise refracting layers, but wherein the layers are provided having differing refractive indices.

Utilising refracting plates to shift virtual light source positions of lighting elements carries the possible advantage over previously described embodiments—employing physical displacement of elements—that manufacture of the lighting panel might be rendered simpler and the optical characteristics of the panel more flexible to changes. For example an almost identical manufacturing process may be employed for producing lighting elements for the lighting panels of differing lateral and vertical extensions (having therefore differing optical requirements), since only the refractive index of provided refracting plates needs to be changed. This is in contrast to physical displacement based embodiments, in which different PCBs or different physical spacers would need to be formed and applied.

However, the embodiment of FIG. 8 carries the potential disadvantage of greater costs associated with providing large numbers of optical plates 88, and also with individually coupling or overlaying these plates to the required lighting elements.

Above were described examples in which lighting elements of different subgroups are adapted such that their light emitting top surfaces occupy different positions relative to the surface of the reflector. These included shifting the heights of the lighting elements using underplaced submounts (FIG. 5) and by vertically extending the dimensions of certain lighting elements (FIG. 6).

Figure 9:
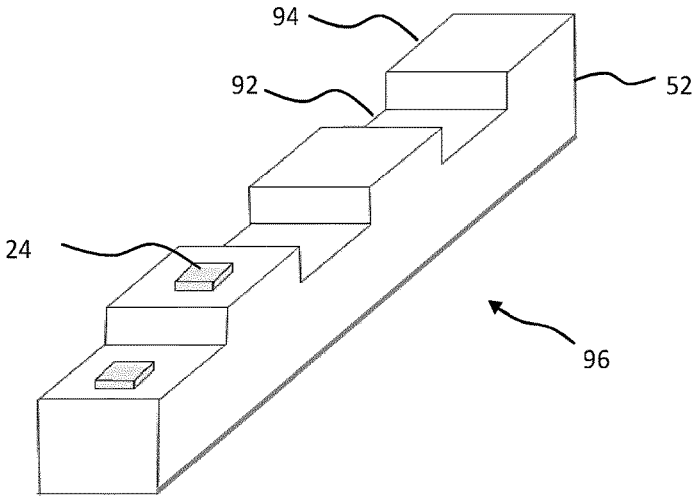
FIG. 9 shows a portion of a fourth example arrangement of lighting elements, comprising a PCB of varying thickness.

In alternative examples, however, the same displacement shift effect may be achieved through instead manipulating or adapting the underlying PCB upon which the lighting elements are mounted or coupled. For example, FIG. 9 shows a section of an exemplary row 96 of lighting elements in accordance with the invention, wherein the underlying PCB 52 is adapted so as to have alternating thinner sections 92 and thicker sections 94. When identical lighting elements 24 are mounted consecutively, one atop the surface of each section, interleaved subsections are created, wherein the second comprises lighting elements having elevated vertical displacement, and hence reduced displacement from the surface of the reflector.

Figure 10:
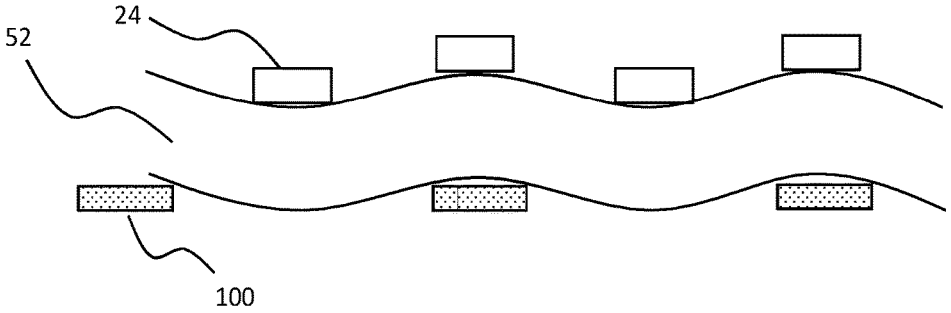
FIG. 10 shows a portion of a fifth example arrangement of lighting elements.

Another possible example is shown in FIG. 10. Here the PCB 52 has uniform thickness along the extent of the row, however the board is physically raised at regular points by filler submounts 100 positioned underneath which act to deform the PCB and elevate lighting elements mounted to the surface of the board above them. The PCB might in some examples be deformed before the lighting elements are mounted, or might alternatively be deformed after elements have been mounted.

Figure 11:
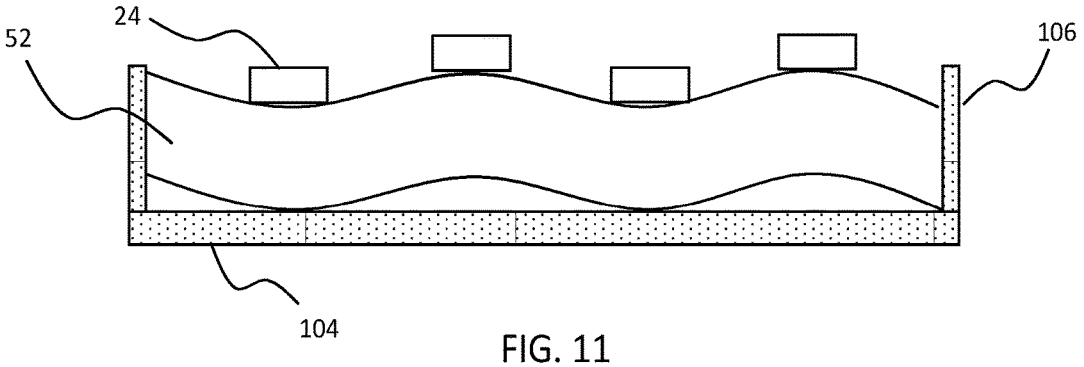
FIG. 11 shows a portion of a sixth example arrangement of lighting elements.

In a variation on this embodiment, FIG. 11 shows an example of a row of lighting elements 24 mounted on undulating PCB 52, wherein the warping of the board is achieved by utilising a PCB which is constructed deliberately too long for the given space, and then containing it within confining base 104 and side 106 elements. Here, as in the previous embodiments, the lighting elements 24 may be mounted to the PCB prior to warping or after warping.

Figure 12:
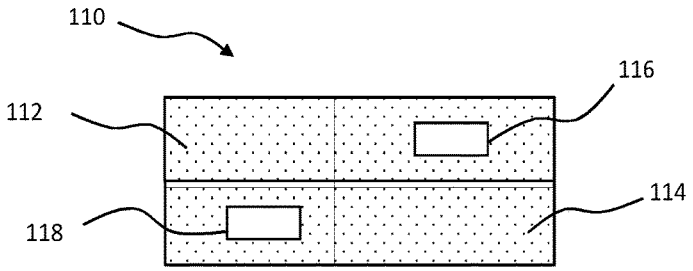
FIG. 12 shows a portion of a seventh example arrangement of lighting elements.

Rather than alternately varying the heights of consecutively mounted lighting elements, one might in some embodiments alternatively employ integrated lighting element packages which include light emitting surfaces at two different levels. One means of realising this might be to assemble a package containing lighting elements, such as LEDs, at two different levels within the package. An example of such a package is shown in FIG. 12. LED package 110 comprises dual layers 112, 114, one atop the other. Within each layer is mounted or contained an LED lighting element 116, 118, being disposed at different lateral positions within their respective layers, such that light emitted from each may propagate freely. The two layers may be adapted to comprise different thicknesses, thereby allowing differing height separations to be achieved. Such packages might then be arranged in rows along the length of the lighting panel, thereby creating an equivalent arrangement of alternating lighting elements as in embodiments of FIGS. 9-11.

Figure 13:
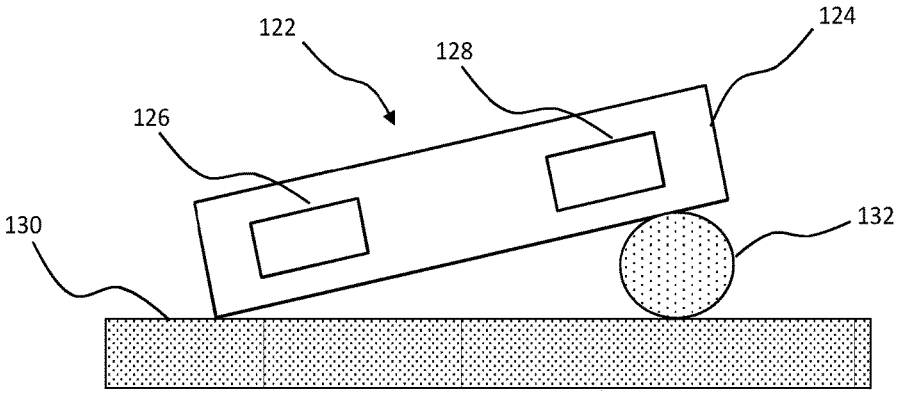
FIG. 13 shows a portion of a eighth example arrangement of lighting elements.

In FIG. 13 is shown in schematic form an example arrangement utilising an alternate integrated lighting element package. In this example, the lighting package 122 comprises just a single layer 124, and the single layer contains two lighting elements 126, 128 disposed at different lateral positions within it. The vertical displacements of the two lighting elements relative to the PCB 130 are adapted to differ from one another by mounting the package 122 at an angle by use of a submount 132 positioned beneath one side of the package.

Figure 14:
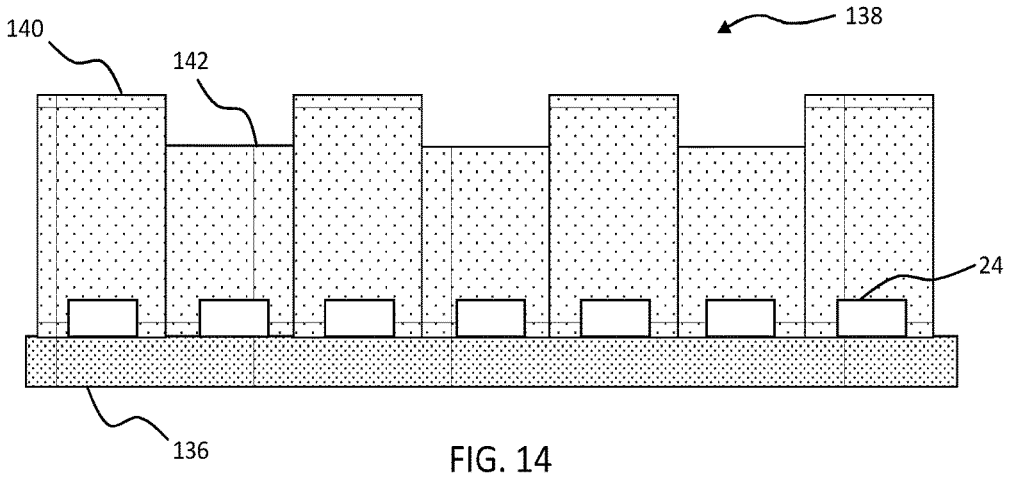
FIG. 14 shows a portion of a ninth example arrangement of lighting elements.

In some embodiments, it might be preferred to induce alternative vertical displacements between consecutive lighting elements and reflector surface, not by manipulating the mounting heights of lighting elements, but rather by manipulating the surface of the reflector structure itself. In FIG. 14 is shown one example of such an arrangement. Here, a row of lighting elements 24 are mounted at uniform vertical displacement relative to a supporting PCB 136. However, the overlaid reflector structure 138 is segmented, and odd 140 and even 142 elements displaced relative to one another. As a consequence there is induced for alternate lighting elements a shifted vertical displacement between the lighting element and the surface of the reflector structure 138.

In other examples, the reflector is manipulated in other ways in order to achieve a similar result. For example, a partially reflective layer may be added to alternate segments of the reflector surface, at a level beneath its primary surface. In this way, the optical path between alternating lighting elements and a reflective surface is shortened compared with the remaining lighting elements. In other examples, the shape of the mirror might be changed so as to have different vertical surface positions at different lateral locations, for example by warping the mirror, or by creating regularly spaced depressions in the metal.

According to another example, incident luminosity of lighting elements belonging to a second subset might be reduced relative to that of the first by 'throwing away' part of the light generated by the first subset, either by blocking part of the incident light at the corresponding portion of the mirror, or by inducing the lighting elements themselves to generate beam profiles at a lower power.

In combination with any of the above described embodiments, additional features might also be included for improved or altered functionality as appropriate for different particular applications. For example, the acoustic tile may perform part of the optical function of the lighting panel. It may for example have a bottom surface which has a light reflecting or light scattering function. This can be a uniform light processing function or it may be patterned, for example by using a painted pattern. For example, the tile may be provided with a paint load as a function of position on the tile, or its shape could be chosen in a smart way in order to realise different behaviour of the odd and even lighting elements.

In some examples, components might be included for redirecting light which falls on a first part of the acoustic tile (close to mirrors) onto other parts of the tile where it is more required for improvement of uniformity. This might be done for example by use of a Fresnel mirror or lens, or combinations thereof. Again, this could be done differently for odd or even lighting elements.

In some embodiments, the lighting elements, reflector structure and/or refracting plates might be adapted to exhibit mechanical movement. In particular, segments of the reflector structure might for example be adapted to oscillate or shift periodically from a first vertical location to a second vertical location. In this way, the intensity distribution generated by the moving segments would shift in time. If the movement is performed at a fast enough rate (i.e. faster than around 24 oscillations per second), then an observer sees both distributions simultaneously. Where the two are adapted to blend uniformly, then an observer sees a uniform distribution of light across the output panel.

Thus, it will be understood that the first and second light intensity profiles across the width of the light output area may be combined in a time sequential manner or else simultaneously in time.

In some embodiments, part, or parts, of the mixing chamber (the internal volume of the lighting panel) might be filled with a medium of a different refractive index to the surrounding atmosphere. This might, for example, play the role of the refracting layer within the relevant embodiments, as an alternative to utilising refractive plates.

Other variations to the disclosed embodiments can be understood and effected by those skilled in the art in practising the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting panel, comprising:

a light output area, having a width across which a light output is to be generated;

a reflector structure, having a reflective surface facing at least in part in the direction of the light output area; and one or more rows of solid state lighting elements, having a light-emitting top surface, arranged beneath the reflector structure, the row or rows extending perpendicularly to the width of the light output area;

wherein the solid state lighting elements together comprise at least two subsets of lighting elements, the subsets including:

a first subset creating a first light intensity profile across the width of the light output area, and a second subset creating a second light intensity profile across the width of the light output area, wherein the combined intensity profiles create a third light intensity profile across the width of the light output area of greater uniformity than either the first or second intensity profiles, and wherein the first subset of solid state lighting elements are adapted to generate beam profiles against the surface of the reflector corresponding to virtual light source positions of a first perpendicular displacement relative to the light output area, and the second subset of solid state lighting elements are adapted to generate beam profiles against the surface of the reflector structure corresponding to virtual light source positions of a second perpendicular displacement relative to the light output area.

2. A lighting panel as claimed in claim 1, wherein the lighting elements of the first subset of lighting elements are interleaved with the lighting elements of the second subset of lighting elements.

3. A lighting panel as claimed in claim 1, wherein the reflector has constant cross-sectional shape along the row direction.

4. A lighting panel as claimed in claim 1, wherein the reflector structure comprises a first portion at one side of the panel, and a second portion at the other side of the panel, each portion having a respective set of one or more rows of lighting elements arranged beneath.

5. A lighting panel as claimed in claim 1, wherein for each row of lighting elements, adjacent elements in the row belong to different subsets.

6. A lighting panel as claimed in claim 1, wherein one or more subsets of the solid state lighting elements comprise a refracting layer positioned optically downstream from the light-emitting top surface, where the refracting layer shifts virtual light source positions of the one or more subsets by a predetermined amount.

7. A lighting panel as claimed in claim 6, wherein the refracting layer comprises a refracting plate.

8. A lighting panel as claimed in claim 1, wherein each subset of lighting elements is coupled to the surface of a respective PCB, the surface of each PCB having a plurality of perpendicular displacements from the output area at different points along the length of the row, wherein each subset is arranged to propagate light in substantially the same angular direction.

9. A lighting panel as claimed in claim 1, wherein the reflector structure comprises one or more parabolic reflector elements.

10. A lighting panel as claimed in claim 1, further comprising an acoustically absorbing back surface, with the reflector structure sandwiched between the light output area and the back surface.

11. A lighting panel as claimed in claim 1, wherein the light output area of the lighting panel comprises a partially transparent layer.

12. A lighting panel as claimed in claim 1, wherein the solid state lighting elements comprise one or more LEDs.

* * * * *